US011187490B2

(12) United States Patent
Tseng

(10) Patent No.: US 11,187,490 B2
(45) Date of Patent: Nov. 30, 2021

(54) REMAINING COMPRESSED AIR RELEASE DEVICE FOR AIR-SOFT

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 0 days.

(21) Appl. No.: 17/015,101

(22) Filed: Sep. 9, 2020

(65) Prior Publication Data

US 2020/0400400 A1 Dec. 24, 2020

(51) Int. Cl.
*F41B 11/62* (2013.01)
*F41B 11/724* (2013.01)
*F41B 11/80* (2013.01)

(52) U.S. Cl.
CPC ..... *F41B 11/724* (2013.01); *F41B 11/62* (2013.01); *F41B 11/80* (2013.01)

(58) Field of Classification Search
USPC ..... 124/74
See application file for complete search history.

(56) References Cited

U.S. PATENT DOCUMENTS

RE27,568 E * 1/1973 Vadas et al. ..... F41B 11/62 124/76
8,550,062 B2 * 10/2013 Maeda ..... F41B 11/62 124/74
10,151,553 B2 * 12/2018 Yu ..... F41B 11/56
10,228,212 B1 * 3/2019 Wei ..... F41B 11/721

FOREIGN PATENT DOCUMENTS

DE 202020105357 U1 * 11/2020 ..... F41B 11/62

* cited by examiner

*Primary Examiner* — Reginald S Tillman, Jr.

(57) ABSTRACT

An air-soft gun includes a grip; a high-pressure air canister disposed in the grip; and a remaining compressed air release device including a channel member threadedly secured to an end of the air canister and including an axial channel and a sealing ring; a rotatable cap releasably secured to the channel member; a biasing member fastened between the cap and the channel member; a striker including a needle on a first end, an internal passageway, an inlet proximate the needle and communicating with the passageway, an outlet proximate a second end and communicating with the passageway, internal threads on the passageway proximate the second end, and a threaded fastener driven through the cap into the internal threads to secure the cap to the striker. The inlet is blocked by the sealing ring in an inoperative position.

1 Claim, 11 Drawing Sheets

REMAINING COMPRESSED AIR RELEASE DEVICE FOR AIR-SOFT

BACKGROUND OF THE INVENTION

1. Field of the Invention

The invention relates to air-soft guns and more particularly to an air-soft gun including a device for releasing remaining compressed air in the pistol-grip so that a subsequent release of compressed air from an air canister in a firing operation can be made easy.

2. Description of Related Art

Conventionally, compressed air may remain in a space between an air canister and an inner surface of a pistol-grip of an air-soft gun after firing. This has disadvantages of a great force being required to exert in a next firing, and increased probability of being hurt.

Thus, the need for improvement still exists.

SUMMARY OF THE INVENTION

It is therefore one object of the invention to provide an air-soft gun comprising a pistol-grip; a high-pressure air canister disposed in the pistol-grip; and a remaining compressed air release device comprising an externally threaded, cylindrical channel member threadedly secured to an end of the air canister and including an axial channel and a sealing ring; a rotatable cap releasably secured to the channel member; a biasing member fastened between the cap and the channel member and urging against the channel member; a striker including a needle on a first end, an internal passageway, an inlet proximate the needle and communicating with the passageway, an outlet proximate a second end and communicating with the passageway, internal threads on the passageway proximate the second end, and a threaded fastener driven through the cap into the internal threads to secure the cap to the striker; wherein the inlet is blocked by the sealing ring in an inoperative position of the remaining compressed air release device; and wherein a clockwise rotation of the cap causes the sealing ring to unblock the inlet, thereby flowing compressed air in the pistol-grip to the outlet through both the inlet and the passageway.

The above and other objects, features and advantages of the invention will become apparent from the following detailed description taken with the accompanying drawings.

BRIEF DESCRIPTION OF THE DRAWINGS

FIG. 6 is a sectional view taken along line B-B of FIG. 5 showing the inlet unblocked for allowing the remaining compressed air in the pistol-grip to release through;

DETAILED DESCRIPTION OF THE INVENTION

Figure 1:
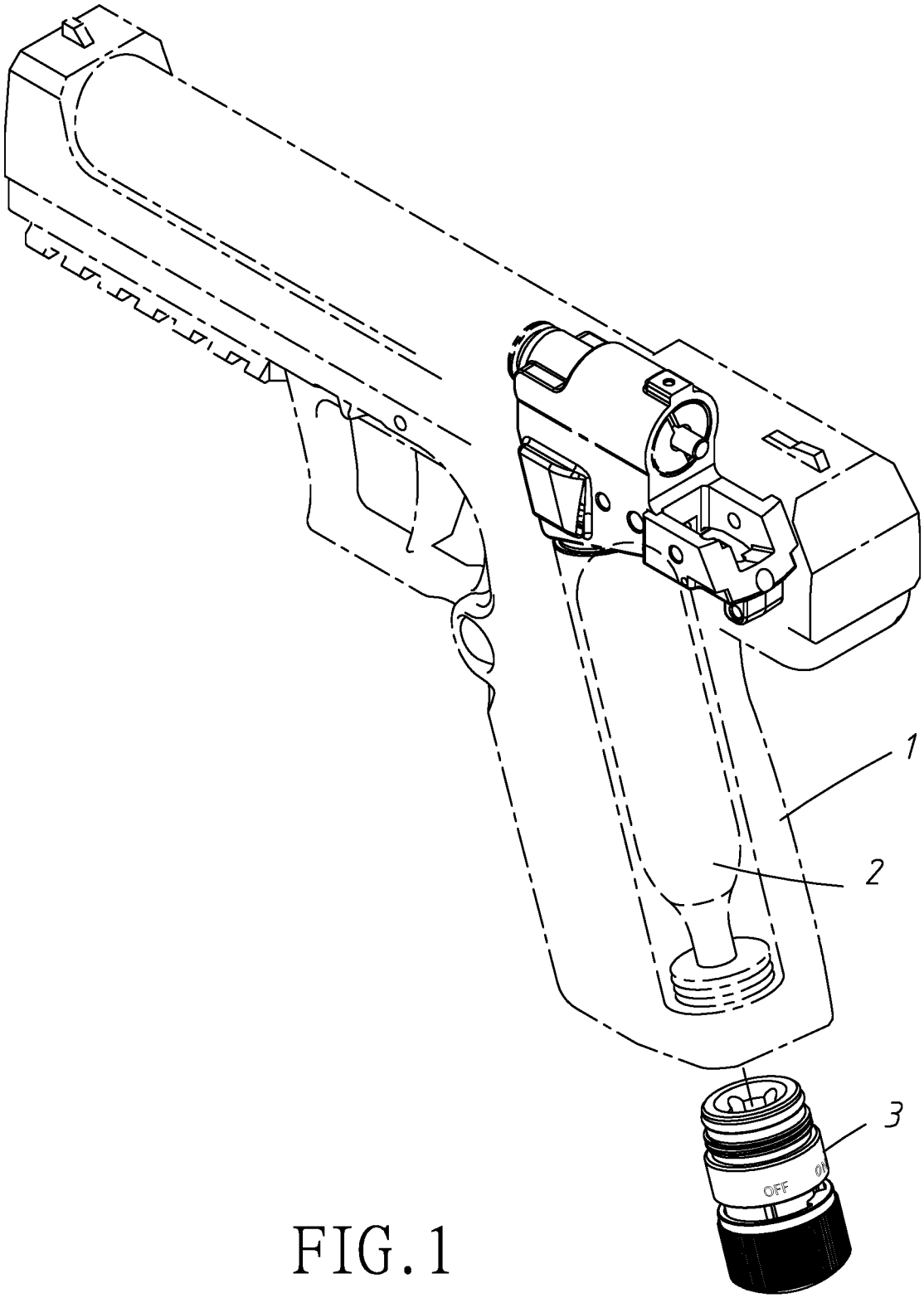
FIG. 1 is a perspective view of an air-soft gun incorporating a remaining compressed air release device according to the invention.
Figure 2:
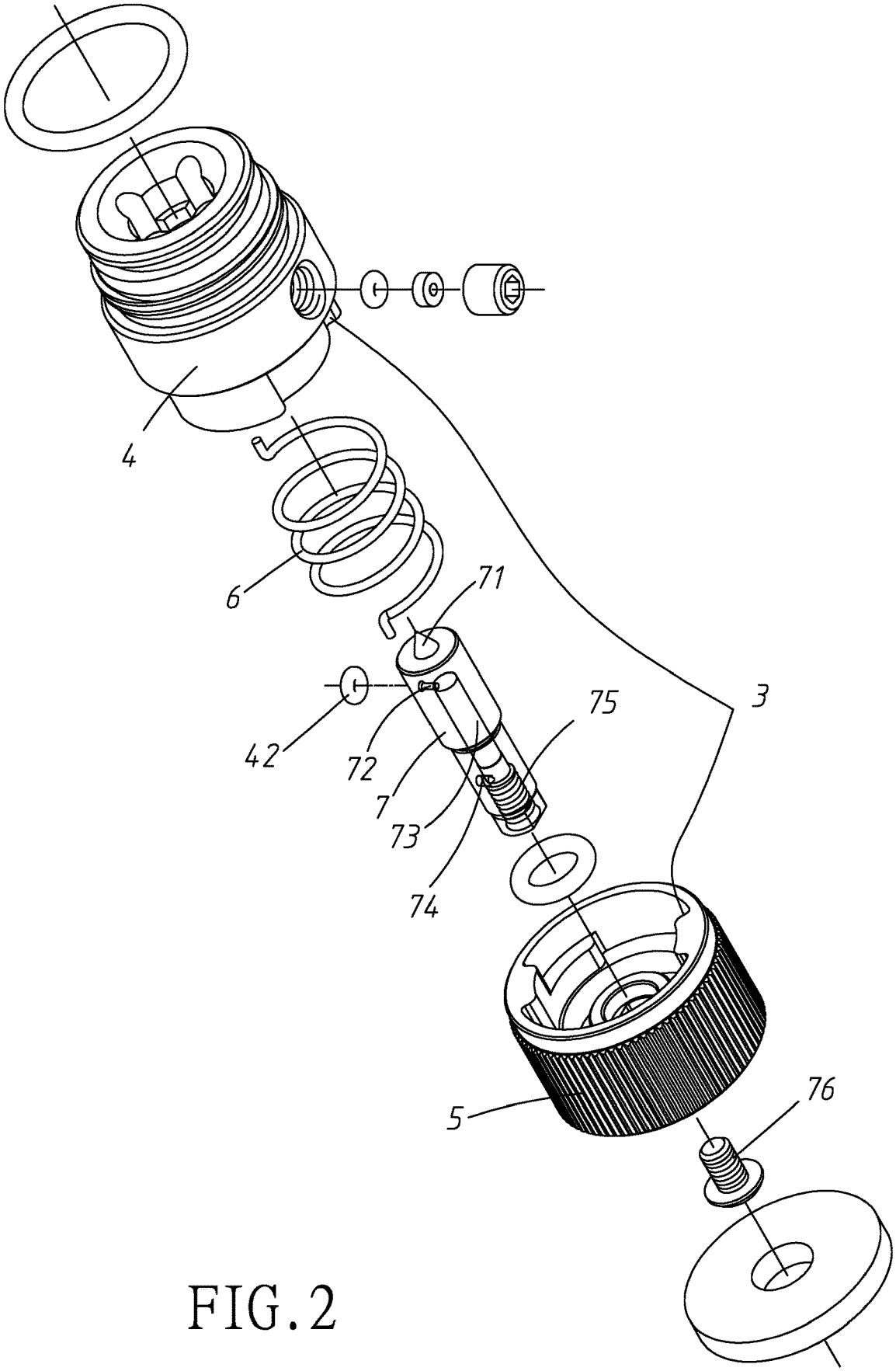
FIG. 2 is an exploded view of the remaining compressed air release device.
Figure 3:
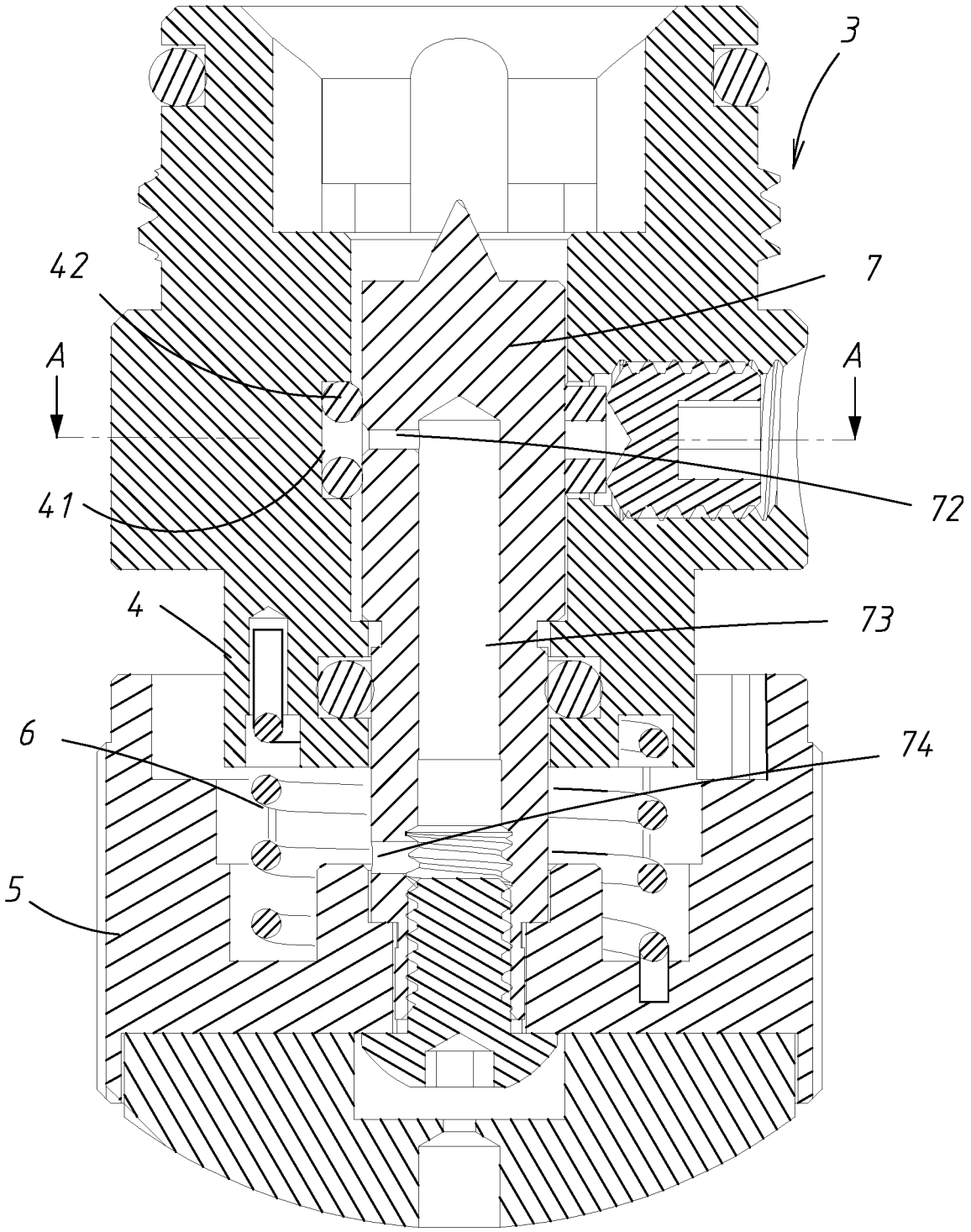
FIG. 3 is a longitudinal sectional view of the assembled remaining compressed air release device.
Figure 4:
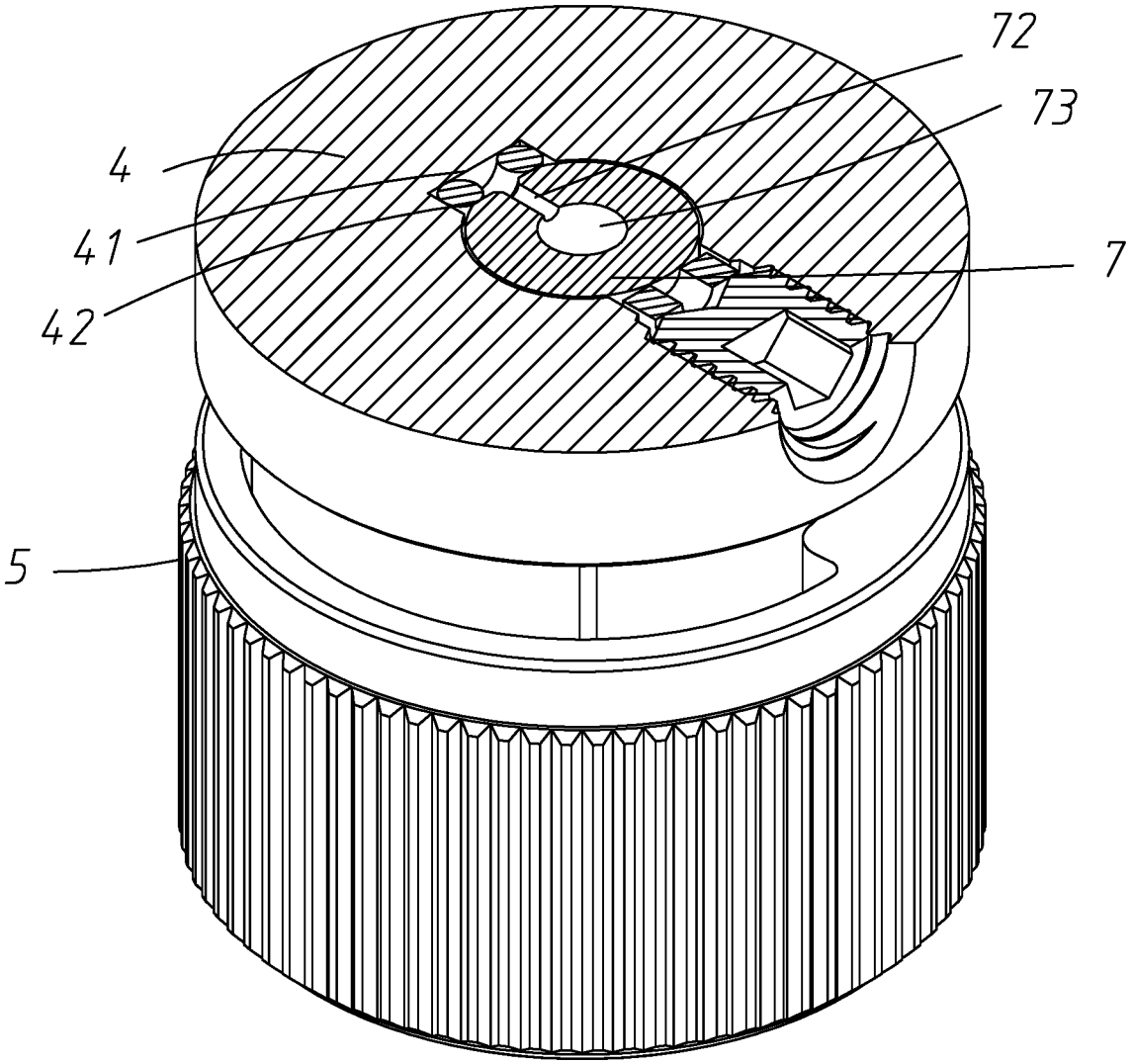
FIG. 4 is a sectional view taken along line A-A of FIG. 3 showing the inlet blocked prior to releasing the remaining compressed air in the pistol-grip.

Referring to FIGS. 1 to 11, an air-soft gun in accordance with the invention comprises a pistol-grip 1; a high-pressure air canister 2 disposed in the pistol-grip 1; and a remaining compressed air release device 3 including an externally threaded, cylindrical channel member 4 threadedly secured to an end of the air canister 2 and including an axial channel 41 and a sealing ring 42; a rotatable cap 5 releasably secured to the cylindrical channel member 4; a compression spring 6 fastened between the cap 5 and the cylindrical channel member 4 and urging against the cylindrical channel member 4; a striker 7 including a needle 71 on a first end, an internal passageway 73, an inlet 72 proximate the needle 71 and communicating with the passageway 73, an outlet 74 proximate a second end and communicating with the passageway 73, internal threads 75 on the passageway 73 proximate the second end, and a screw 76 driven through the cap 5 into the internal threads 75 to secure the cap 5 to the striker 7. The inlet 72 is blocked by the sealing ring 42 in an inoperative position of the air-soft gun (see FIGS. 3 and 4).

Figure 5:
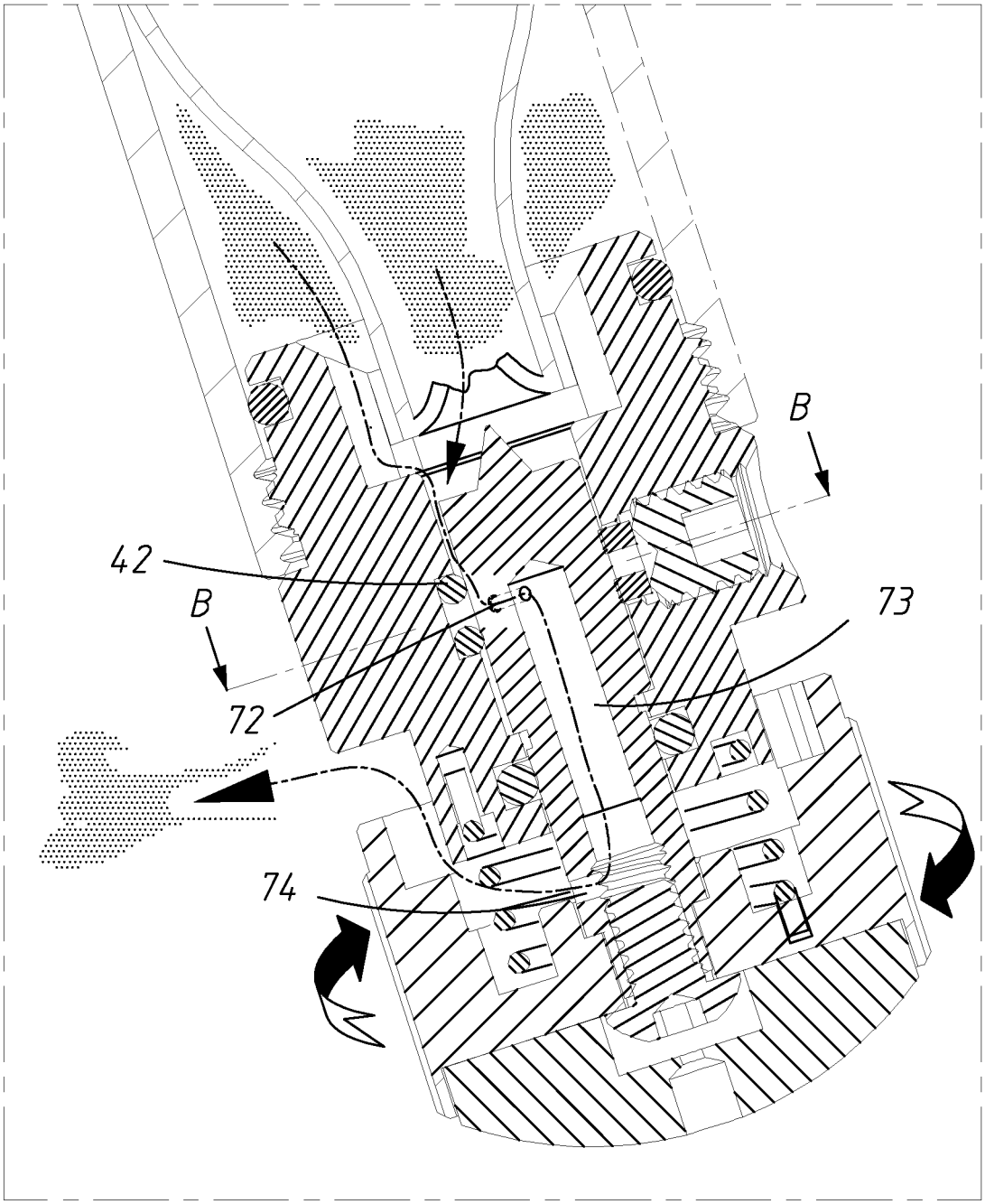
FIG. 5 is a view similar to FIG. 3 showing in response to rotating the cap the remaining compressed air released to the external through the inlet, the passageway and the outlet.
Figure 6:
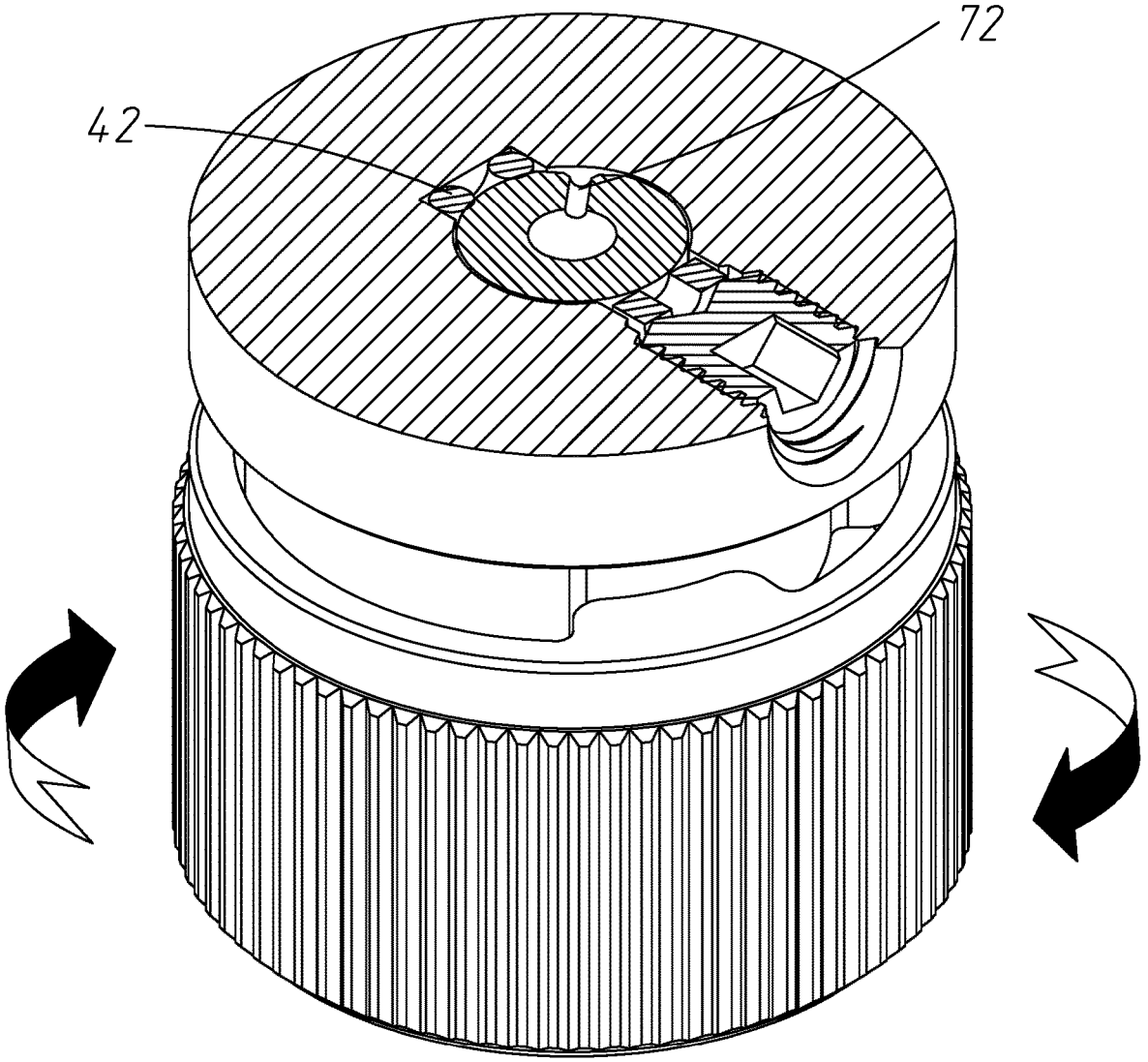
Figure 7:
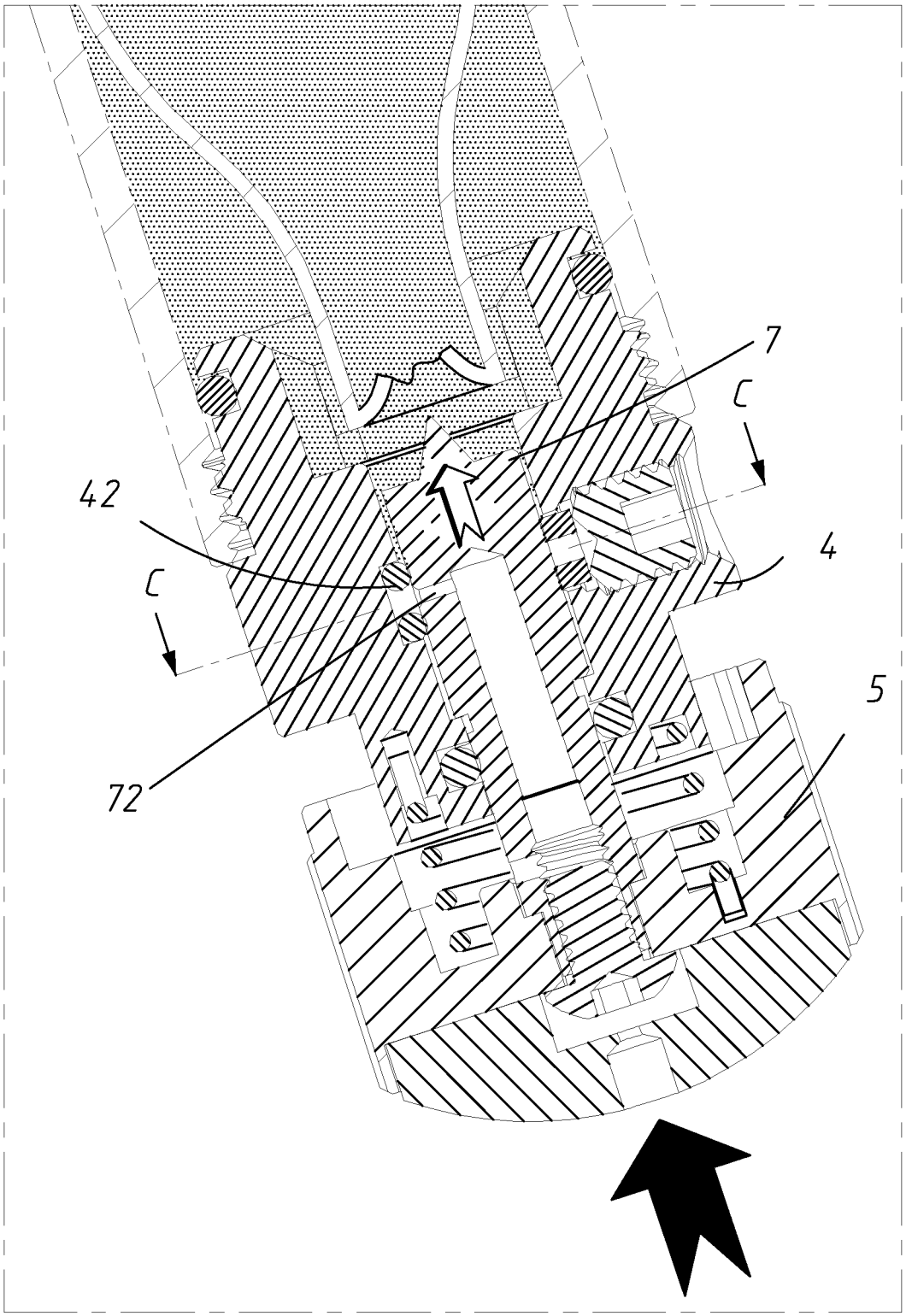
FIG. 7 is a view similar to FIG. 5 showing in response to pushing the cap the needle moved forward to pierce the sealed opening of the air canister for releasing pressurized air from the air canister prior to firing.
Figure 8:
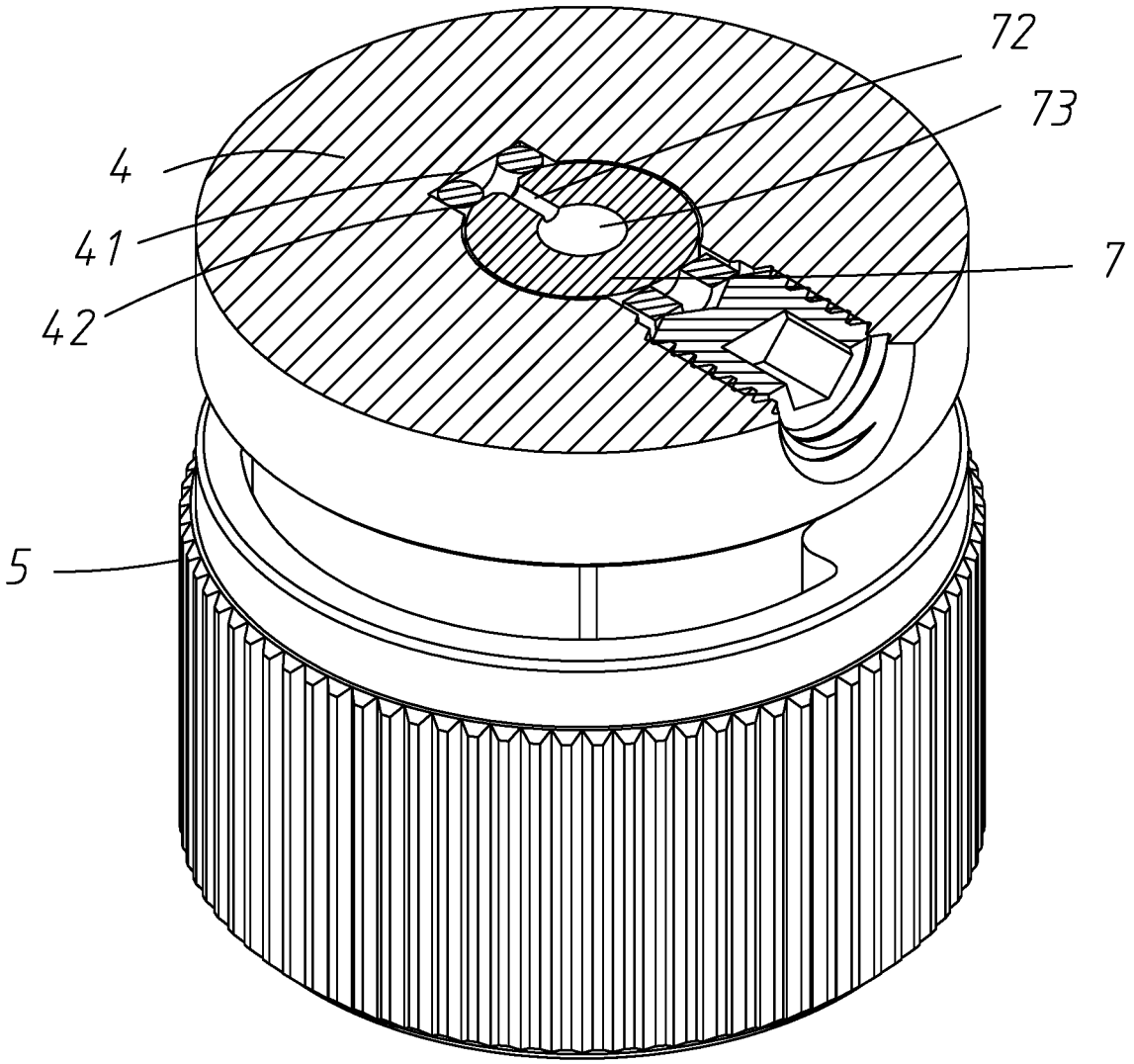
FIG. 8 is a sectional view taken along line C-C of FIG. 7.
Figure 9:
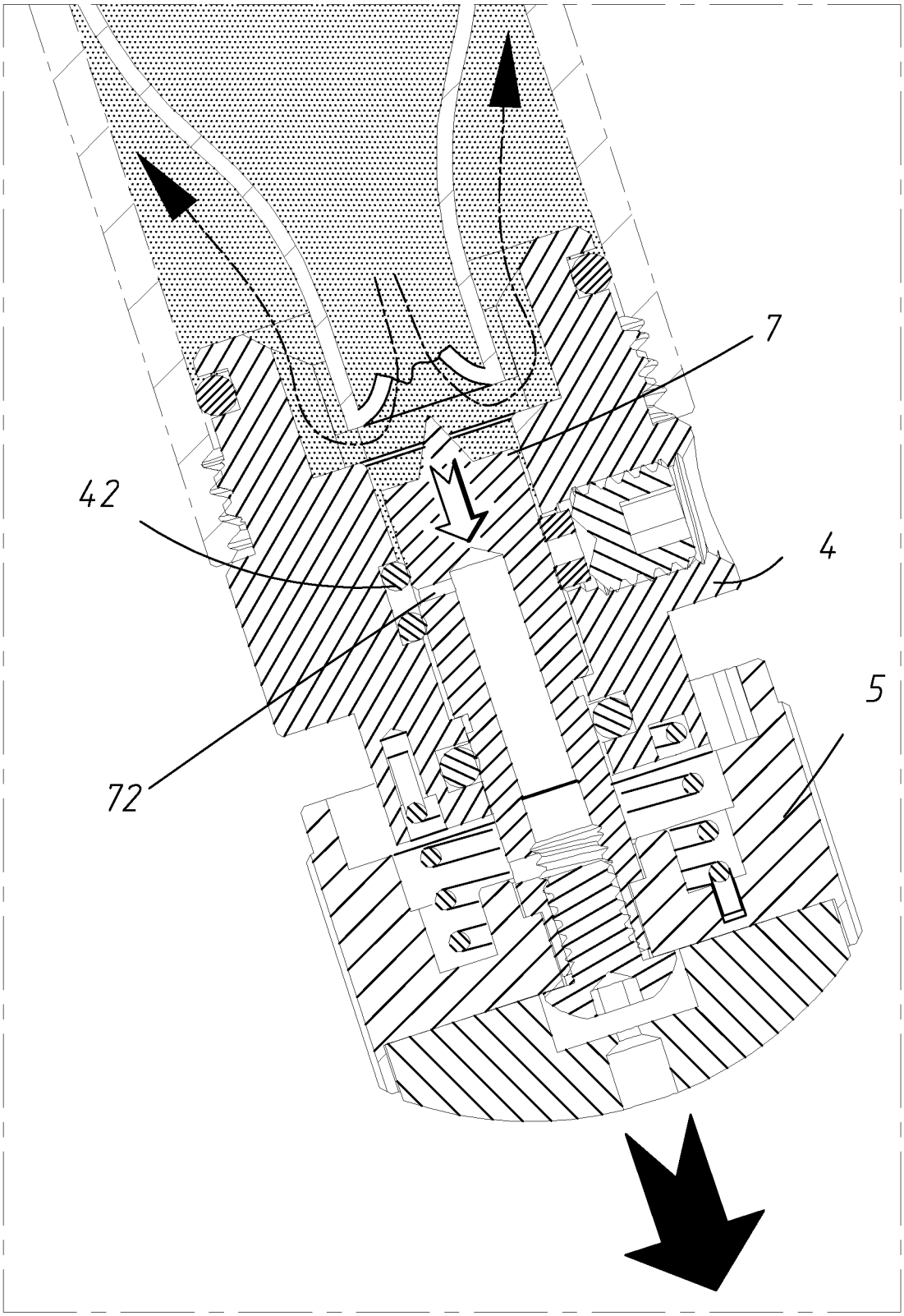
FIG. 9 is a view similar to FIG. 7 showing in response to releasing pressurized air from the air canister both the needle and the cap bounced back.

A remaining compressed air release operation of the invention is discussed in detail below. As shown in FIGS. 5 and 6, firstly, an individual may use hand to clockwise rotate the cap 5 to rotate the striker 7. As such, the inlet 72 is not blocked by the sealing ring 42. Thus, the remaining compressed air in the pistol-grip 1 (i.e., being stored in a space between the air canister 2 and an inner surface of a pistol-grip 1) is released to the external through the inlet 72, the passageway 73, and the outlet 74. After the rotation, the energized compression spring 6 releases its elastic force to return both the cap 5 and the striker 7 to the inoperative position (see FIGS. 3 and 4). Next, the individual may push the cap 5 to move the striker 7 forward until a sealing opening of the air canister 2 is pierced by the needle 71, thereby releasing pressurized air from the air canister 2 to the firing mechanism to be ready for firing (see FIGS. 7 and 8). After the air release, both the needle 71 and the cap 5 bounce back to the inoperative position (see FIG. 9).

Figure 10:
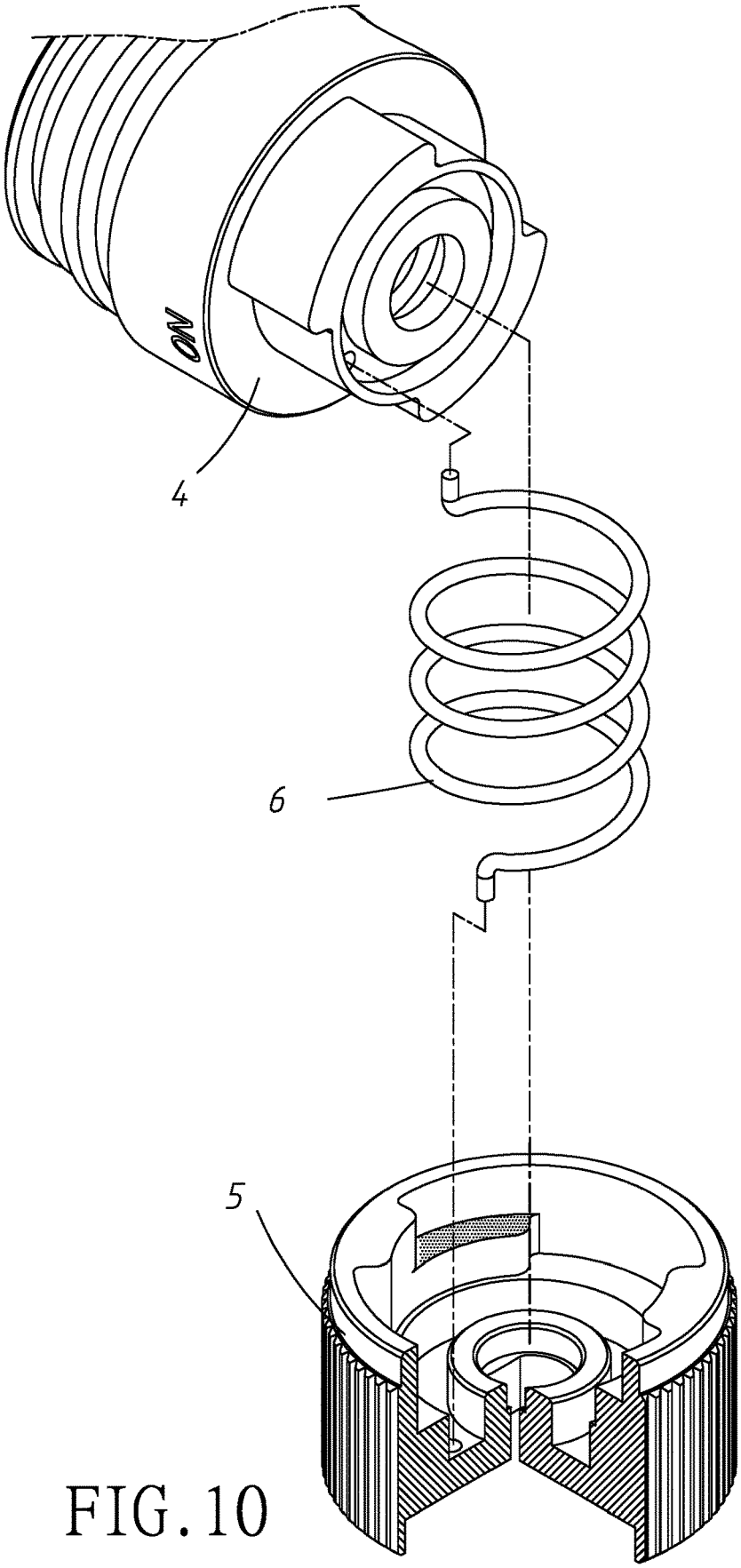
FIG. 10 schematically depicts the compression spring fastened between the cap and the cylindrical channel member.
Figure 11:
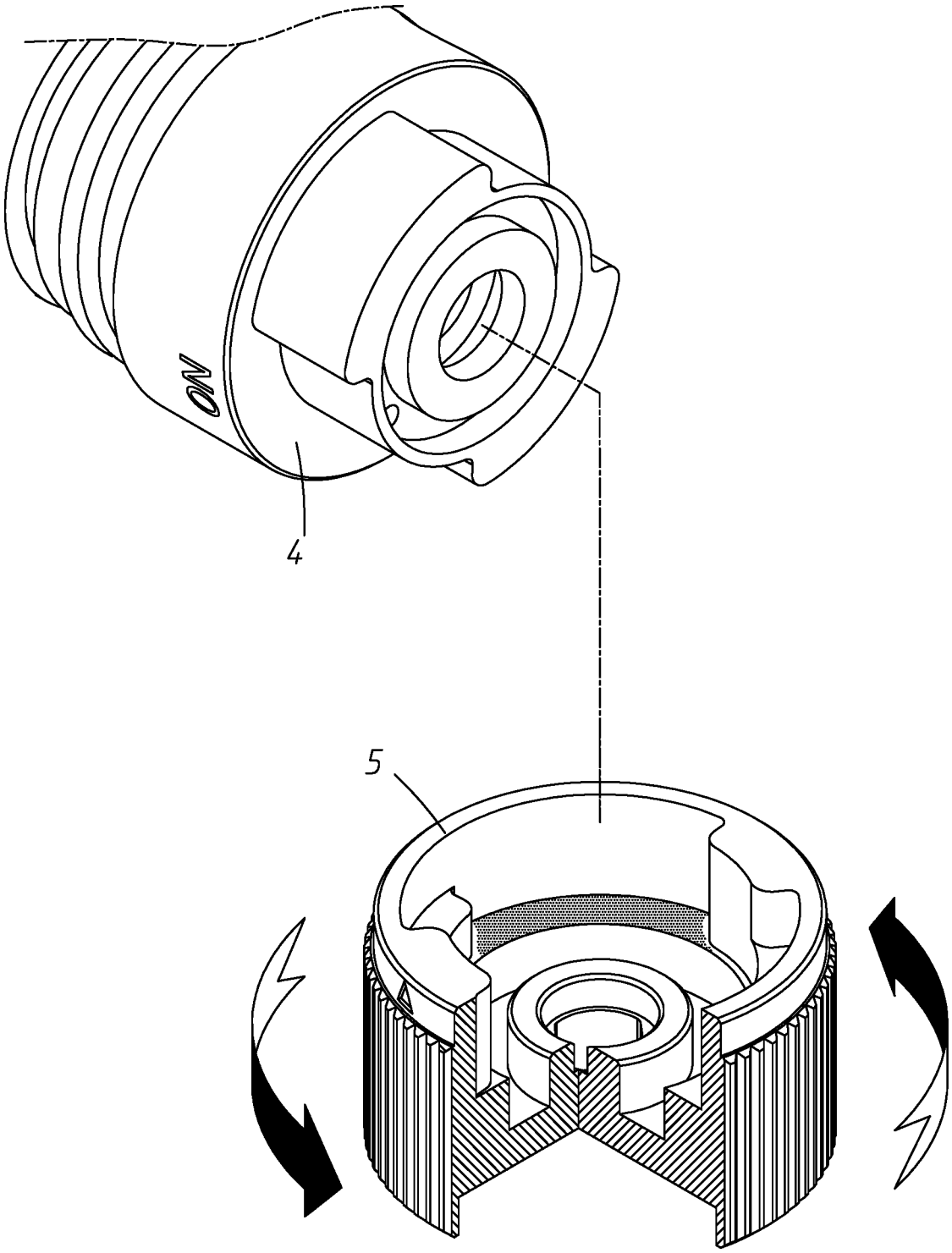
FIG. 11 schematically depicts the mounting of the cap to the cylindrical channel member.

As shown in FIGS. 10 and 11 specifically, after the firing, the individual may disengage the sealing ring 42 from the inlet 72 to release the remaining compressed air externally of the air canister 2. Next, the compression spring 6 releases its elastic energy to rotate both the cap 5 and the striker 7 to an on position so that the individual may push the cap 5 to release remaining compressed air externally of the air canister 2 in a next operation.

While the invention has been described in terms of preferred embodiments, those skilled in the art will recognize that the invention can be practiced with modifications within the spirit and scope of the appended claims.

What is claimed is:

1. An air-soft gun comprising:

a pistol-grip;

a high-pressure air canister disposed in the pistol-grip; and a remaining compressed air release device comprising an externally threaded, cylindrical channel member threadedly secured to an end of the air canister and including an axial channel and a sealing ring; a rotatable cap releasably secured to the channel member; a biasing member fastened between the cap and the channel member and urging against the channel member; a striker including a needle on a first end, an internal passageway, an inlet proximate the needle and communicating with the passageway, an outlet proximate a second end and communicating with the passageway, internal threads on the passageway proximate the second end, and a threaded fastener driven through the cap into the internal threads to secure the cap to the striker;

wherein the inlet is blocked by the sealing ring in an inoperative position of the remaining compressed air release device; and wherein a clockwise rotation of the cap causes the sealing ring to unblock the inlet, thereby flowing compressed air in the pistol-grip to the outlet through both the inlet and the passageway.

* * * * *